US011472599B2

(12) United States Patent
Hartl

(10) Patent No.: US 11,472,599 B2
(45) Date of Patent: Oct. 18, 2022

(54) COLLAPSIBLE RING AND TRANSPORT CONTAINER WITH A COLLAPSIBLE RING

(71) Applicant: DUROtherm Kunststoffverarbeitung GmbH, Haiterbach (DE)

(72) Inventor: Andreas Alexander Hartl, Haiterbach (DE)

(73) Assignee: DUROtherm Kunststoffverarbeitung GmbH, Haiterbach (DE)

( * ) Notice: Subject to any disclaimer, the term of this patent is extended or adjusted under 35 U.S.C. 154(b) by 143 days.

(21) Appl. No.: 16/802,735

(22) Filed: Feb. 27, 2020

(65) Prior Publication Data

US 2020/0277102 A1 Sep. 3, 2020

(30) Foreign Application Priority Data

Feb. 28, 2019 (DE) ..... 10 2019 105 062.6

(51) Int. Cl.
*B65D 19/18* (2006.01)

(52) U.S. Cl.
CPC .... *B65D 19/18* (2013.01); *B65D 2519/00034* (2013.01); *B65D 2519/00069* (2013.01); *B65D 2519/00174* (2013.01); *B65D 2519/00208* (2013.01); *B65D 2519/00273* (2013.01); *B65D 2519/00288* (2013.01); *B65D 2519/00318* (2013.01); *B65D 2519/00641* (2013.01); *B65D 2519/00711* (2013.01); *B65D 2519/00875* (2013.01)

(58) Field of Classification Search
CPC ..... B65D 19/00; B65D 19/18; B65D 2519/00034; B65D 2519/00875; B65D 2519/00641
USPC ..... 206/386, 600; 220/660, 676, 4.28, 529, 220/554
See application file for complete search history.

(56) References Cited

U.S. PATENT DOCUMENTS 4,368,675 A * 1/1983 Propst ..... B65D 19/44 108/53.1
9,277,814 B2 * 3/2016 Winker ..... A47B 96/021
(Continued)

FOREIGN PATENT DOCUMENTS

DE 20 2010 002 290 U1 6/2010
DE 10 2013 013 744 A1 2/2015
(Continued)

*Primary Examiner* — Rafael A Ortiz
(74) *Attorney, Agent, or Firm* — Renner, Otto, Boisselle & Sklar, LLP

(57) ABSTRACT

The invention relates to a collapsible ring made of several side walls (15, 16) for a transportation container (11), which is positioned to stand on a palette base (12) of a transportation palette (13) and surrounds an interior (19) delimited by the side walls (15, 16), and at least one intermediate base (31) that can be arranged in the ring (14) in a usage position (32) and having at least one releasable connection (34) formed between the side wall (15, 16) and the intermediate base (31), said connection being formed by at least one holding element (36), wherein adjacent and/or opposing side walls (15, 16) are held by the releasable connection (34) at a distance to the intermediate base (31), and the intermediate base (31) is simultaneously positioned by the releasable connection (34) to the usage position (32) in relation to the adjacent side wall.

19 Claims, 6 Drawing Sheets

(56) References Cited

U.S. PATENT DOCUMENTS

Figure 1:
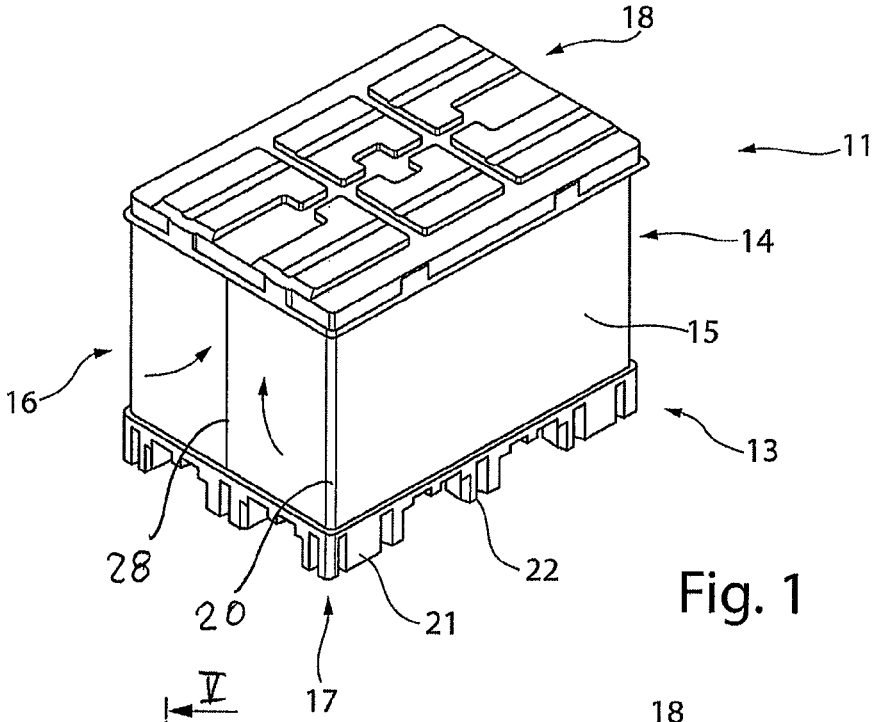

| | | | | |
|---|---|---|---|---|
| 9,981,774 | B2 * | 5/2018 | Park | B65D 19/18 |
| 2009/0218344 | A1 * | 9/2009 | Villasante | B65D 85/34 220/6 |

FOREIGN PATENT DOCUMENTS

| | | | |
|---|---|---|---|
| EP | 3 147 232 | A1 | 3/2017 |
| GB | 2 377 695 | A | 1/2003 |

* cited by examiner

COLLAPSIBLE RING AND TRANSPORT CONTAINER WITH A COLLAPSIBLE RING

The invention relates to a collapsible ring made of several side walls for a transportation container and a transportation container, wherein the collapsible ring can be positioned to stand on a palette base of a transportation container.

A transportation container for transporting or storing goods is known from EP 3 147 232 A1, said transportation container having a transportation palette having a palette base, on which several side walls forming a ring can be placed. A container interior delimited by the side walls extends upwardly from a palette base. A container upper part or a cover can be placed onto the side walls in order to close the container inner part. Such a collapsible ring has folding edges in the corner regions, such that the ring can be collapsed after use by folding, in particular an M fold. This can be placed onto the palette base for the space-saving return transportation.

A further transportation container having a palette base, side walls and a container upper part is known from DE 10 2013 013 744 A1. Foldable support elements are provided on the insides of the side walls. These support elements are aligned to be flush to the side wall in a non-usage position. In a usage position, these can be pivoted around 90°, such that these support elements protrude horizontally aligned into the container interior in order to place an intermediate base thereon.

With such transportation containers, the requirement for stability and also for the use of the transportation volume increasingly rises.

The object of the invention is therefore to propose a collapsible ring made of several side walls for a transportation container and a transportation container, in which one or more intermediate bases can be positioned easily inside a collapsible ring and enables an increase of the stability of the collapsible ring.

The object is solved by a collapsible ring having at least one intermediate base, which can be arranged therein, in which the intermediate base engages on the side walls by means of at least one releasable connection, wherein this connection simultaneously holds the intermediate base at a distance apart from the side wall and simultaneously positions the intermediate base at the height of the usage position in relation to the side wall. The intermediate base is fixedly held on at least two opposing and/or at least two adjacent side walls at a distance apart from the side walls and at the height in relation to the side walls. Thus, the side walls, on which the intermediate base engages, are held fixedly in relation to one another and reinforced. The collapsible ring, which is positioned between a transportation palette and a container upper part, can, in the event of several transportation containers being stacked one above the other, enable an improved load removal onto the lowermost transportation palette. A bulging of the side walls in the event an acting load when containers are stacked one on top of the other can be counteracted by the releasable connection between the side walls and the intermediate base.

The releasable connection preferably comprises the at least one holding element and at least one engagement element. The holding element and the engagement element can preferably be connected to each other in a force-fit and/or in a form-fit manner. On one hand, this enables a simple positioning of the intermediate base in the usage position in relation to the ring and, on the other hand, the force-fit and/or form-fit connection, by means of which the side wall is fixedly held at a fixed distance to the intermediate base.

It is preferably provided that the intermediate base having at least one engagement element provided on a side edge of the intermediate base or holding element is applied to a holding element or engagement element on the side wall and forms a first connection and can then be transferred into the usage position by a pivoting movement, in which usage position the at least one engagement element or holding element provided on a further, in particular opposite, side edge of the intermediate base engages on the holding element of the side wall. This enables a simple insertion of the intermediate base into the ring, such that the force-fit and/or form-fit connection between the side wall and the intermediate base can be created following on from two adjacent and, in particular, two opposite side edges.

The intermediate base is preferably held to be suspended in relation to the side walls. Because of the gravity of the intermediate base, this independently maintains the force-fit and/or form-fit connection between the holding elements and the engagement elements after the insertion and transfer into the usage position.

In the usage position of the intermediate base in relation to the side wall, it is preferably provided that the engagement element engages behind the holding element. Thus, the intermediate base forms a reinforcement or a kind of ribbing between two opposing and/or adjacent side walls. At the same time, a partition of the container interior into several chambers can be carried out.

An advantageous embodiment of the collapsible ring provides that several holding elements or engagement elements are arranged in a common vertical alignment and with a distance apart from one another on an inside of the side wall. This makes it possible for an intermediate base to be able to be inserted at various heights in relation to the palette base. Several intermediate bases can also be arranged in the container interior.

The holding element of the force-fit and/or form-fit as well as releasable connection preferably comprises a recess having an upper and lower engagement region, wherein the length of the upper engagement region in the vertical direction is greater than the width of the upper engagement region. This makes it possible for a connection between the holding element and the gripping element to be made possible by pivoting the intermediate base into the usage position.

It is preferably provided that the engagement element is formed as a spigot or hook, which abuts on the opening edge of the recess and has a front-face end, which engages behind the opening edge. This spigot can be provided with a front plate, for example, whose diameter is greater than the periphery of the spigot. The spigot or hook can also have a groove, such that the opening edge of the recess can engage into the groove of the spigot or hook for positioning the intermediate base in the usage position. In both cases, there is an engagement behind of the engagement element in relation to the holding element.

Furthermore, it is preferably provided that the recess of the holding element has an upper engagement region and a lower engagement region attached thereto, which is tapered in relation to the upper engagement region. This enables a simple threading of the engagement element into the holding element for positioning the intermediate base in the usage position. In particular, the recess is formed in the shape of a keyhole or is funnel-shaped, wherein the narrowed engagement region is the lower two engagement regions.

A further preferred embodiment provides that in each case at least two holding elements arranged at a distance apart from the central longitudinal axis of the side walls are provided on opposite insides of the side walls. Thus, the intermediate base can be positioned and held in relation to the ring, for example by means of a 4-point bracket.

Furthermore, it is preferably provided that the intermediate base has a peripheral front side, which, in the usage position, lies opposite the inside of the side walls, from which the at least one engagement element outwardly extends. Thus, intermediate bases that can be stacked well can be created.

The engagement element can preferably be integrally moulded on the intermediate base. For example when producing the intermediate base as a twin sheet plate, the engagement element can be integrally moulded. Alternatively, the engagement element can also be introduced as an insert when producing the intermediate base. The engagement element can also be fixable to the intermediate base, such as, for example, by means of a screw connection, welding or a plug/latching connection.

Furthermore, it is preferably provided that the one holding element or several holding elements lying one above the other are formed as an injection moulded part and are fixed to the inside of the side wall. These can be fixed to the side wall by welding, adhering, riveting, stamping or similar, for example. Alternatively, it can be provided that the holding element or holding elements are integrally moulded on an inside of the side wall. This is the case, in particular, with side walls which are produced by thermoforming or deep-drawing, in particular as a twin sheet component.

According to a further preferred embodiment, it is provided that the holding elements and the engagement elements engage in one another in a first alignment of the intermediate base for the side arrangement for adopting the usage position and are guided past one another in a further alignment of the intermediate position in relation to the side walls for adopting a stored position. This makes it possible for the intermediate bases to be able to be stacked one on top of the other on the palette base when transporting the transportation containers back to be refilled with goods, wherein a ring positions the intermediate bases stacked one on top of the other in alignment to the palette base. Thus, a secured return transport can be made possible. It is preferably provided that the intermediate base, based on the first alignment, which corresponds to the usage position, is rotated around 180° in a horizontal plane, such that subsequently the holding elements and engagement elements can be guided past one another to adopt the stored position.

According to a first embodiment for positioning the holding elements and the engagement elements, it is provided that at least two holding elements arranged at the same distance apart from the central longitudinal axis are provided on the inside of the one side wall, and at least two holding elements arranged with the same distance apart from the central longitudinal axis are provided on the inside of the opposite side wall, wherein the distance apart of the holding elements on the opposite side wall is shortened by the width of the respective holding element, and the engagement element of the intermediate base is provided opposite the holding elements in an alignment for adopting the usage position. This arrangement makes it possible for a few engagement elements between the holding elements and the opposite engagement elements outside the holding elements to be guided past the opposite side wall when rotating the intermediate base around 180° for adopting the stored position.

An alternative arrangement of the projections and engagement elements provides that at least two holding elements arranged at a distance apart from the central longitudinal axis are provided on the inside of the one side wall, wherein the one distance apart differs from the other distance in terms of the width of the holding element, and the holding elements are arranged on the inside of the opposite side wall point-symmetrically or in a mirror image to a central line between the side walls opposite one another, and the engagement elements of the intermediate base are provided opposite the holding elements with an alignment in the usage position. When rotating the intermediate base in a horizontal plane around 180°, a simple transfer from the usage position into the stored position can also be made possible as a result of this arrangement.

An advantageous embodiment of the intermediate base provides that notches are provided on at least two opposing front sides, said notches corresponding at least to double the width of the holding elements when seen in the vertical direction and having a depth which corresponds at least to the protrusion of the holding element into the container interior. This arrangement makes it possible for a gap between a peripheral front side of the intermediate base and the insides of the side walls to be made smaller or even to be sealed.

Furthermore, it is preferably provided that the insertion parts are positioned in the notches provided on the frontal sides of the intermediate base and extend within an envelope formed by the frontal side of the intermediate base. Thus, a particularly closed positioning of the intermediate base in relation to the side walls adjacent thereto can be procured.

Furthermore, it is preferably provided that the side walls are connected to an intermediate web to form a foldable corner region, and a folding edge is preferably provided, in particular embossed, between the side wall and the intermediate web. The intermediate web is formed in terms of width in such a way that, in the folded-together state of the ring, the length of the intermediate web at least corresponds to the depth of the holding element and engagement element protruding into the container interior.

Furthermore, the object of the invention is solved by a transportation container having a transportation palette, a container upper part and a ring in between consisting of several side walls for connecting the container upper part to the base, in which the collapsible ring having the at least one intermediate base is formed according to one of the preceding embodiments.

An advantageous embodiment of the transportation container provides that a first intermediate base in a stored position abuts on the palette base of the transportation palette and the first intermediate bases on the first intermediate base, and the stacked intermediate bases rest in alignment with the palette base by means of the collapsible ring placed on the transportation palette. Thus, the intermediate bases can be provided stacked in a space-saving manner for the return transportation. The further unnecessary transportation containers can be return-transported in a folded-together state, in which the collapsible ring abuts on the palette base and is covered by the container upper part.

Figure 2:
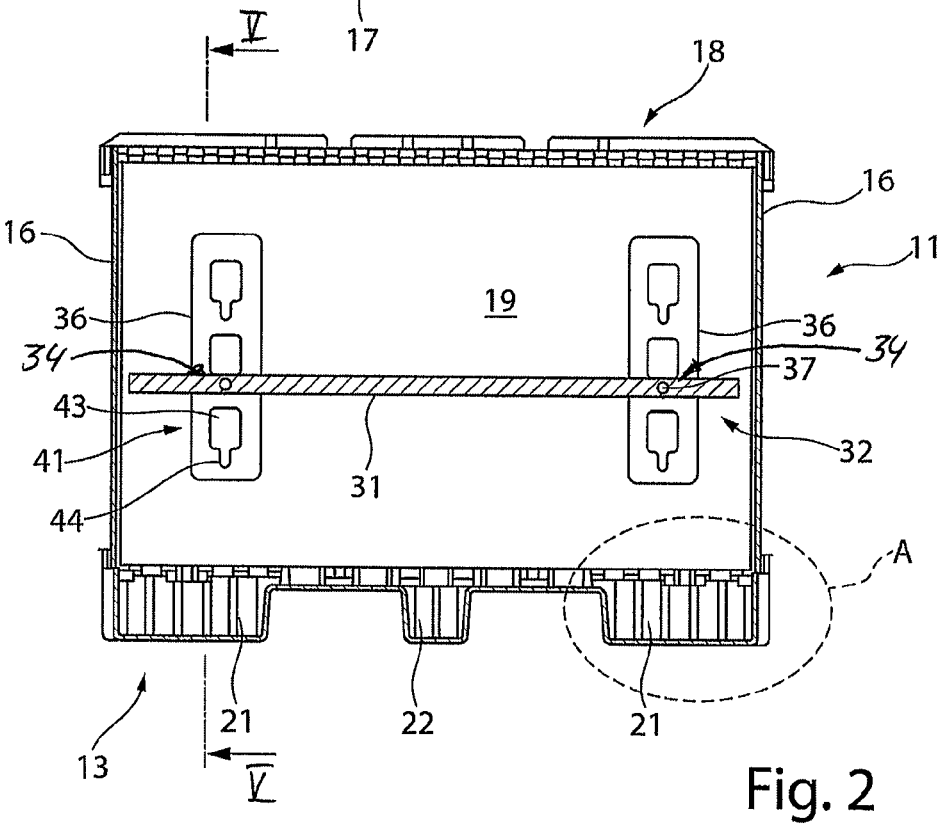
Figure 3:
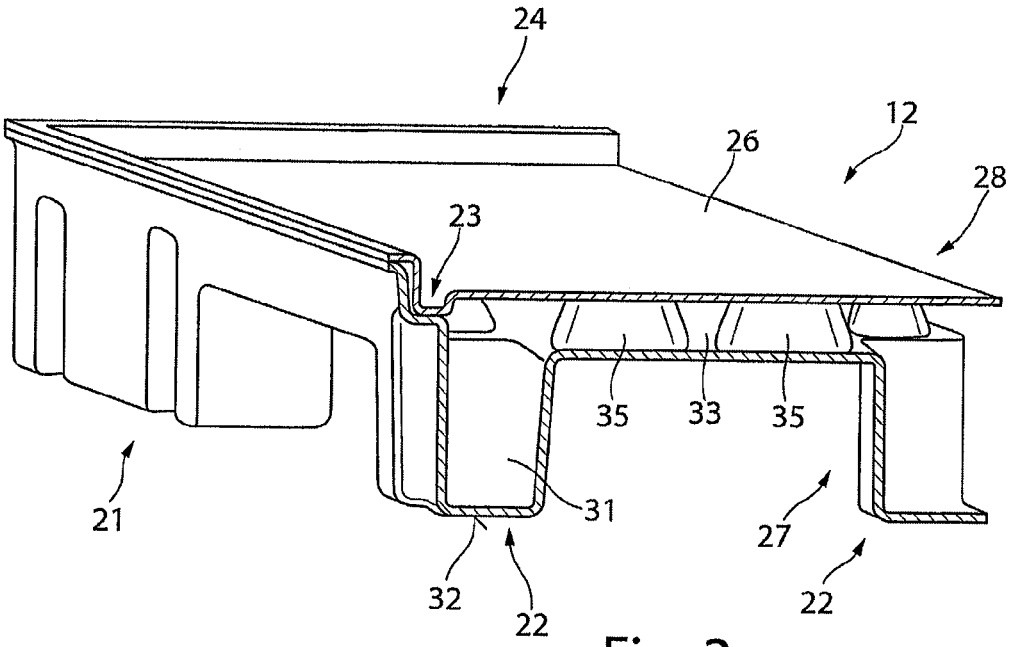
Figure 4:
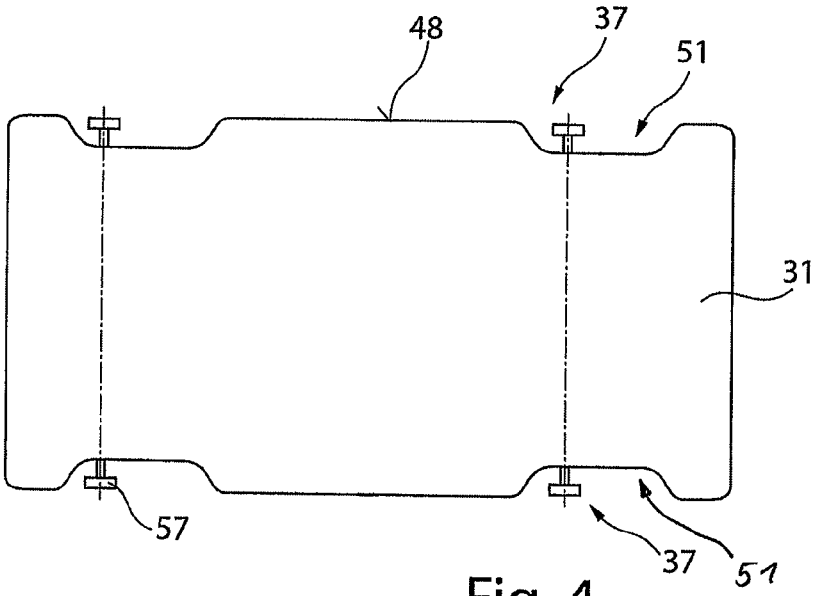
Figure 5:
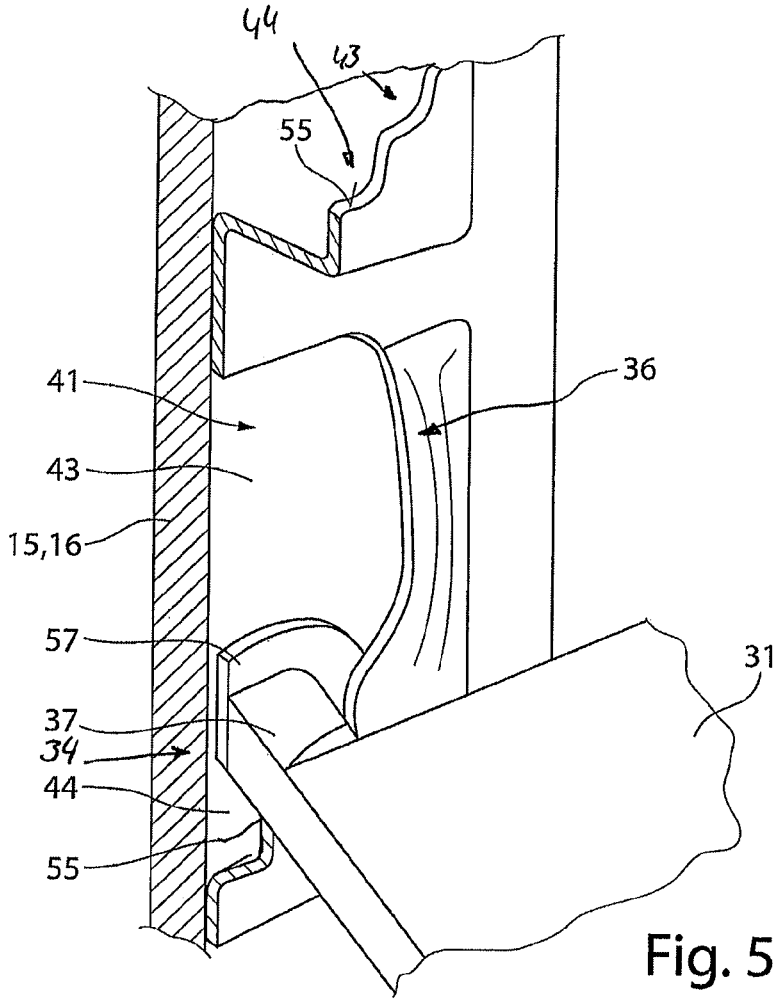
Figure 6:
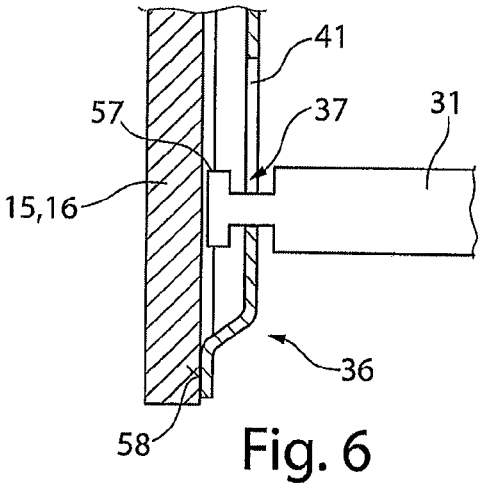
Figure 7:
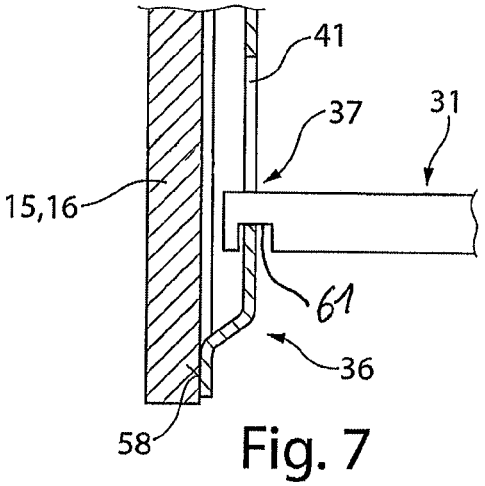
Figure 8:
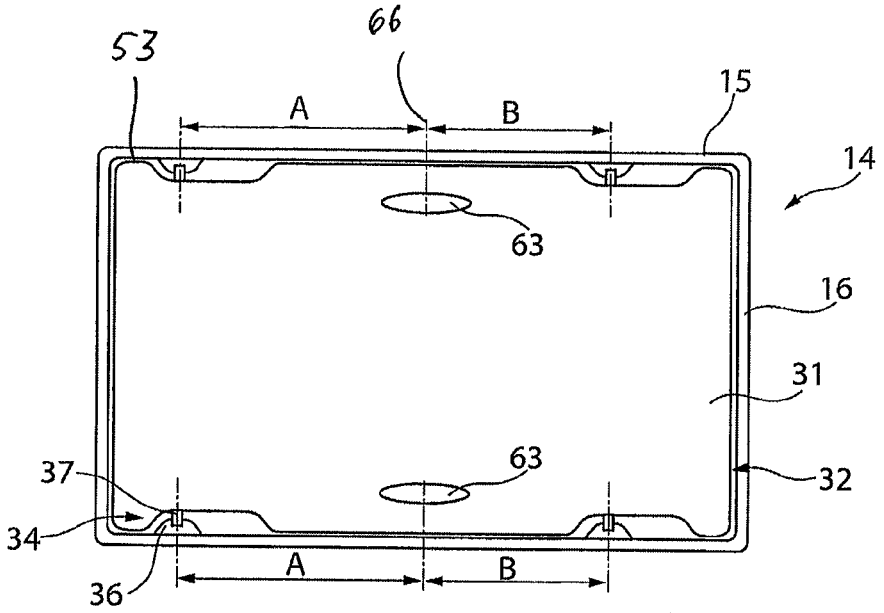
Figure 9:
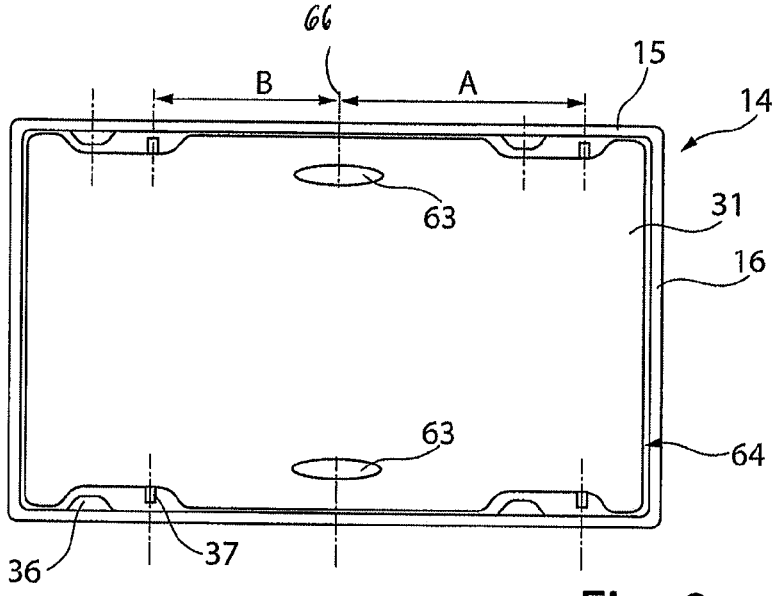
Figure 10:
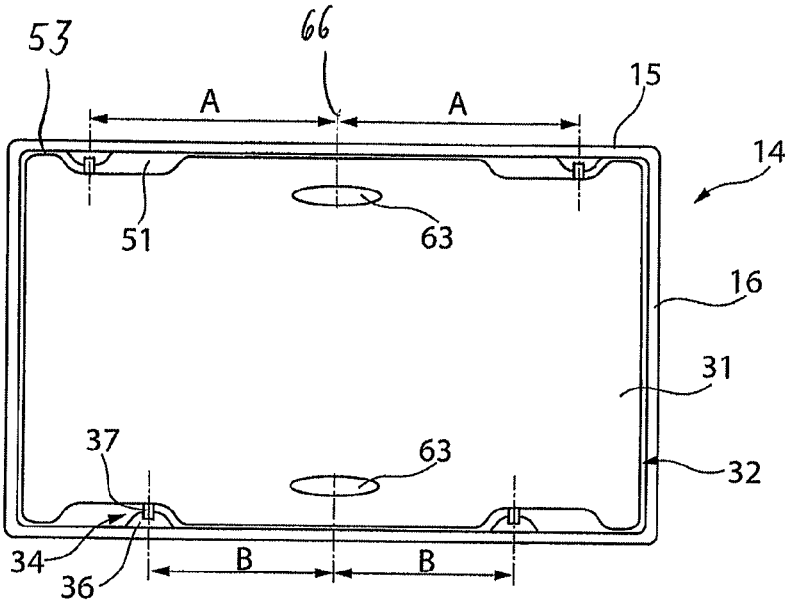
Figure 11:
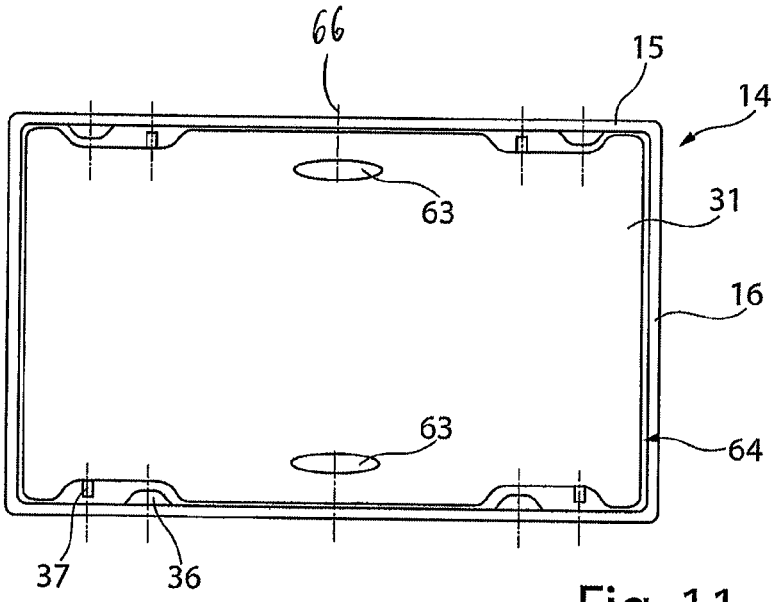
Figure 12:
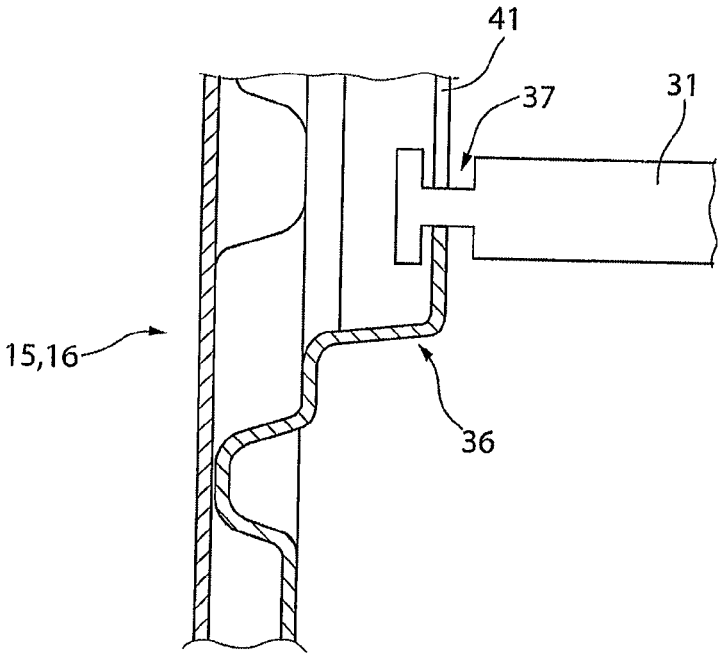

The invention and further advantageous embodiments and developments thereof are described and explained below in more detail by means of the examples depicted in the drawings. The features that can be seen in the description and the drawings can be applied individually or in any combination according to the invention. Here are shown:

FIG. 1 a perspective view of a transportation container,

FIG. 2 a schematic sectional view of the transportation container according to FIG. 1, FIG. 3 a perspective view of detail A in FIG. 2, FIG. 4 a schematic view from above of an intermediate base, FIG. 5 a perspective view of a force-fit and/or form-fit connection between a side wall of the transportation container and the intermediate base, FIG. 6 a schematic side view of the arrangement according to FIG. 5;

FIG. 7 a schematic side wall of an alternative embodiment to FIG. 6,

FIG. 8 a schematic view from above of the ring with the intermediate base in a usage position according to FIG. 2, FIG. 9 a schematic view from above of a collapsible ring having the intermediate base in a stored position, FIG. 10 a schematic view from above of an alternative embodiment to FIG. 8, FIG. 11 a schematic view of the intermediate base according to an embodiment in FIG. 10 in a stored position, FIG. 12 a schematic side view of an alternative embodiment to FIG. 6.

In FIG. 1, a transportation container 11 for storing and/or transporting wares, goods, package freight or bulk cargo is provided in a perspective view. FIG. 2 shows the transportation container 11 according to FIG. 1 in solid cross-section. Here, it is a reusable container.

This transportation container 11 comprises a transportation palette 13 having a palette base 12 and a collapsible ring 14, which is formed, for example, from four side walls 15, 16, which are connected to one another in the respective corner region 17. The number of side walls 15, 16 and their allocation is adjusted to the base shape of the transportation palette 13 or the palette base 12. In the exemplary embodiment, a rectangular palette base 12 is provided, such that two long side walls 15 and two shorter side walls 16 form the ring 14. Alternatively, square palette bases 12 can also be provided with equal-length side walls 15, 16. Similarly, palette bases 12 can be provided which also form rings 14, for example, made of six or eight side walls. The ring 14 is preferably formed as a closed ring 14. All side walls 15, 16 are connected to one another by folding edges 28. In the corner region 17, an intermediate web 20 can be provided, which is connected on both sides to the side walls 15, 16 abutting thereon by means of folding edges 28. A side wall 16 can additionally have a folding edge 28. Thus, the ring 14 can be transferred to an M-fold for the return transport.

The side walls 15, 16 consist, for example, of plastic, in particular of multi-layer plates. Preferably, a structural chamber plate made of three plastic films, for example, can be provided, in which a structured or profiled film, which has nubs, in particular, is provided between two outer planar films. A hollow chamber plate can also be provided.

The folding edges can be introduced into the plates by impressing, in particular with a heated blade.

The transportation container 11 furthermore comprises a container upper part 18 or a cover, which can be placed onto the collapsible ring 14. A closed palette interior 19 is formed by the transportation palette 13, the ring 14 and the container upper part 18. The transportation palette 13 comprises, for example, nine feet 21, which can be moulded on directly.

The transportation palette 13 preferably comprises a peripheral trough 23 in the outer edge region. The trough 23 is surrounded by an edge 24 in the corner regions 17 of the palette base 12. This trough 23 runs along the edge region of the palette base 12. Advantageously, the edge 24 extends completely around the trough 23 and forms an outer closure of the palette base 12. A bearing surface 26 is provided inside the trough 23, said bearing surface being formed as a closed surface and being delimited by the trough 23. The edge 24 is preferably formed to be equal to or higher than the bearing surface 26. The plane of the completely closed bearing surface 26 of the palette base 12 is slightly above the trough 23, such that an indentation for the collapsible ring 14 is formed. The edge 24 is opposite this indentation, said edge having at least the level of the bearing surface 26 or being higher than the bearing surface 26.

An intermediate base 31 is provided in the container interior 19 in a usage position 32. The intermediate base 31 is positioned by means of a force-fit and/or form-fit connection 34 to the side walls 15, 16. The intermediate base 31 is positioned releasably in relation to the side walls 15, 16 and can be applied and removed as needed.

The force-fit and/or form-fit connection has at least one holding element 36 and one engagement element 37. In the embodiment, the at least one holding element 36 is provided on an inside of the side wall 15, 16. The at least one engagement element 37 is provided on the intermediate base 31. Alternatively, the holding elements 36 and engagement elements 37 can also be exchanged.

According to a first embodiment, it is provided that the holding element 36 has three recesses 41, which are aligned at a distance apart from one another and one above the other in the same vertical direction. Alternatively, holding elements 36 can also be provided, which only have one recess or two recesses or several recesses. The holding element 36 is preferably formed as an injection moulded part. This holding element 36 can be fixed on the inside of the side wall 15, 16 by an embossment and/or welding. Alternatively, a rivet connection or a screw connection or a clip/latching connection can also be provided. Preferably, the holding element 36 is fixed on the side wall 15, 16 in such a way that an outside of the side wall remains flat.

The recess 41 of the holding element 36 has an upper engagement region 43 and a lower engagement region 44 attached thereto. The lower engagement region 44 is formed in terms of width to be smaller than the upper engagement region 43. Preferably, the upper engagement region 43 is at least double as long as the lower engagement region 44 in the vertical alignment. Preferably, a keyhole-shaped recess 41 or funnel-shaped recess 41 can be provided.

In FIG. 3, a perspective detailed view A according to FIG. 2 is depicted. The transportation palette 13 is produced, for example, by deep-drawing according to the Twin Sheet method. The transportation container 11 can alternatively also comprise other transportation palettes 13, such as conventional wooden palettes or other transport palettes made of plastic, for example.

In FIG. 4, a schematic view from above of the intermediate base 31 is depicted. The intermediate base 31 is delimited by a peripheral front side 48. Preferably, engagement elements 37 are respectively provided on two opposing front sides. These engagement elements 37 engage in the holding elements 36, as is depicted in FIG. 2.

The intermediate base 31 can be formed as a plate made of plastic. The intermediate base 31 can also be produced as a hollow chamber plate or structured chamber plate and also by means of two plastic films as a Twin Sheet plate. During the production of the intermediate base 31, in particular according to the Twin Sheet method, the engagement element 37 can be integrally moulded thereon. The engagement part 37 can also be formed as an inlay part when producing the intermediate base 31. This inlay part, which is formed, for example, from plastic or metal or similar, can be screwed on, adhered, welded, pressed on or similar.

In the embodiment of the intermediate base 31 depicted in FIG. 4, it is provided that depressions 51 are provided, for example, on two opposing front faces 48. The engagement elements 37 are arranged in these depressions 51. This design has the advantage that a gap 53 between the front face 48 of the intermediate base 31 and an inside of the side walls 15, 16 can be reduced or even closed, as emerges from FIG. 8. In FIG. 8, the intermediate base 31 is depicted in a usage position 32 in relation to the side walls 15, 16 corresponding to FIG. 2. Alternatively, these depressions 51 can also be dispensed with, such that the intermediate base 31 has a corresponding rectangular format with a rectangular palette base.

In FIG. 5, the force-fit and/or form-fit connection 34 between the intermediate base 31 and the side wall 15, 16 is depicted schematically enlarged along the line of intersection V-V in FIG. 2. The engagement element 37 is inserted into the recess 41 through the upper engagement region 43. Then, the engagement element 37 is moved vertically downwards and comes to rest in the lower engagement region 44. The engagement element 37 rests on a lower opening edge 55 of the recess 41. The engagement element 37 has a rear plate 57 according to a first embodiment, said rear plate being greater in terms of periphery than the engagement element 37 formed as a spigot. Thus, this rear plate 57 engages behind the lower engagement region 44.

In FIG. 6, the schematic side view of the arrangement according to FIG. 5 is depicted in more detail. It can be seen in this side view that the rear plate 57 is positioned between the recess 41 and an inside of the side wall 15, 16. The rear plate 57 engages behind the lower engagement region 44 and abuts on the lower opening edge 55. The recess 41 is arranged on the holding element 36 opposite a contact surface 58 of the holding element 36 on the inside of the side wall 15, 16 at a distance pointing into the container interior 19, such that the engagement element 37 can engage and engage behind the lower engagement region 44.

In FIG. 7, a schematic side view of an alternative embodiment of an engagement element 37 to FIGS. 5 and 6 is depicted. In this embodiment, it is provided that the engagement element 37 formed as a spigot has a U-shaped indentation 61. Thus, the lower opening edge 55 of the recess 41 engages in the indentation 61, and a front side end of the engagement element 37 engages behind the lower engagement region 44.

FIG. 8 shows a schematic view from above of the intermediate base 31 in the usage position 32. The connection 34 is provided, by way of example, on two opposing side walls 15, 16. Two releasable connections 34 are provided on each side wall 15, 16, for example.

The opposing force-fit and/or form-fit connections 34, in which a back-engagement of the engagement elements 37 in the holding elements 36 is carried out, make it possible for a bulging of the side walls 15, 16 to be prevented. Instead, a reinforcement of the side walls 15, 16 in relation to one another is achieved, i.e. the side walls 15, 16 are held in a parallel alignment in relation to one another.

By way of example, for inserting the intermediate base 31, this is gripped at the handling openings 63. A first longitudinal side of the intermediate base 31 is positioned by the engagement elements 37 in relation to the desired recess 41 of the holding element 36. The engagement elements 37 are inserted into the upper engagement opening 44 of the holding elements 36 and transferred into the lower engagement opening 43. The intermediate base 31 is positioned on a slant pointing upwards in an intermediate position. Then, a pivot movement into a horizontal plane is carried out, such that the opposing engagement elements 37 engage on the opposing holding elements 36. Firstly, the engagement elements 37 are guided into the upper engagement region 43, in order to then transfer the engagement elements 37 into the lower engagement region 44, as is depicted in FIGS. 5 and 6. Thus, a secured position of the intermediate base 31 is obtained. At the same time, the opposing side walls 15, 16 are held by the intermediate base 31 at a defined distance apart from one another.

A release of the connections 34 on a side wall 15, 16 is carried out by a pivot movement to transfer the intermediate base 31 from the usage position 32 into a stored position 64. Then, the intermediate base 31 is raised easily, such that the engagement elements 37 can be freely guided out via the upper engagement region 43 on the opposite side wall 15, 16. The intermediate base 31 is then rotated around 180° in its horizontal alignment and, in turn, positioned in the ring 14. Here, the intermediate base 31 can be guided past the holding elements 36 until it abuts on the palette base 12 or an intermediate base 31 already placed thereon.

For this, according to this first embodiment, it is provided that the distance A of the first connection from a central longitudinal axis 66 of the side wall 15 is greater than the distance B to a second connection 34 on the same side wall 15. This is carried out analogously on the opposite side wall 15. The engagement elements 37 on the intermediate base 31 are adjusted to these distances A and B. This results in the engagement elements 37, 38 each being positioned adjacent to the holding elements 36 when rotating the intermediate base 31 around 180° out of the usage position 32. Thus, the engagement elements 37 can be guided laterally past the holding elements 36.

In FIG. 10, an alternative embodiment to FIG. 8 is depicted, wherein the transferring from the usage position 32 into the stored position 64 is carried out analogously. In this embodiment, it is provided that the two holding elements 36 are positioned on the side wall 15 with a distance A to the central longitudinal axis 66 of the side wall 15, and the holding elements 36 arranged on the opposite side wall 15 are arranged with a distance B to the central longitudinal axis of the opposite side wall. Thus, when removing the intermediate base 31 from the usage position 32 and a subsequent rotation of the intermediate base 31 in a horizontal plane around 180°, transfer into the stored position 64 is also possible, as is depicted in FIG. 11.

Alternatively, it can also be possible that the holding elements 36 on a side wall 15 have the distance A and the distance B starting from the central longitudinal axis 64 and, on the opposite side wall 15, comprise the distance B and the distance A from the central longitudinal axis 66. This also enables the arrangement of the intermediate base 31 both in the usage position 32 and in the stored position 64.

In FIG. 12, an alternative embodiment of the holding element 36 on the side wall 15, 16 is also depicted. In this embodiment, the side wall 15, 16 is produced from a first or second plastic film according to the Twin Sheet method. The inner plastic film is here moulded and formed in such a way that the recess 41 having the upper and lower engagement region 43, 44 is formed integrally in the internal plastic film. The engagement element 37 on the intermediate base 31 can be formed according to one of the embodiments described above.

The invention claimed is:

1. A collapsible ring made of several side walls for a transportation container, which can be positioned to stand on a palette base of a transportation palette and surrounds an interior delimited by the side walls, and at least one intermediate base that can be arranged in the ring in a usage position and having at least one releasable connection formed between the side wall and the intermediate base, said connection being formed by at least one holding element, wherein the adjacent and/or opposite side walls are held by the releasable connection at a distance from the intermediate base, and the intermediate base is positioned by the releasable connection simultaneously in the usage position in relation to the adjacent side wall, wherein:

a first edge of the intermediate base includes at least a first depression, and at least a first engagement element is provided in the first depression, a second edge of the intermediate base includes at least a second depression, the second edge being opposite the first edge, and at least a second engagement element is provided in the second depression, the at least one holding element includes at least a first holding element on a first side wall, and at least a second holding element on a second side wall, the second side wall being opposite the first side wall, the first holding element having a first recess and the second holding element having a second recess, and the first depression of the intermediate base is configured to receive the first holding element on the first side wall such that the first engagement element is received and releasably connected in the first recess of the first holding element portion, and the second depression of the intermediate base is configured to receive the second holding element on the second side wall such that the second engagement element is received and releasably connected in the second recess of the second holding element.

2. The ring according to claim 1, wherein the first and second holding elements are releasably connected to the respective first and second engagement elements in a force-fit and/or form-fit manner.

3. The ring according to claim 1, wherein the at least one releasable connection is configured to suspend the intermediate base on the side walls in spaced apart relation from the palette.

4. The ring according to claim 1, wherein the first engagement element engages with the first holding element to enable the intermediate base to then be transferred into the usage position by means of a pivoting movement, in which usage position the second engagement element engages the second holding element.

5. The ring according to claim 1, wherein the first and second holding elements and the respective first and second engagement elements engage behind one another in relation to the side walls in the usage position of the intermediate base.

6. The ring according to claim 1, wherein several holding elements are arranged on an inside of the side wall in a common vertical alignment and at a distance one above the other.

7. The ring according to claim 1, wherein at least the first recess has an upper engagement region and a lower engagement region, wherein the upper engagement region has a length in the vertical direction that is greater than a width of the upper engagement region in the horizontal direction.

8. The ring according to claim 7, wherein the lower engagement region of the first recess is narrowed in relation to the upper engagement region of the recess, and the recess is formed in the shape of a keyhole or funnel-shaped.

9. The ring according to claim 7, wherein the first engagement element is formed as a spigot on a front-side end and has a front plate, which is at least partially enlarged in relation to a diameter of the spigot or has a groove-shaped indentation on an underside.

10. The ring according to claim 1, wherein the first and second holding elements and the first and second engagement elements respectively engage in one another in a first alignment of the intermediate base in relation to the side walls for adopting the usage position and are guided past one another in a further alignment of the intermediate base in relation to the side walls for adopting a stored position.

11. The ring according to claim 1, wherein the intermediate base has a peripheral front side, which, in the usage position of the intermediate base, lies opposite an inside of the side walls, and at least the first engagement element is provided on the front side of the intermediate base, said first engagement element extending outwardly and the first engagement element is integrally moulded on the intermediate base, introduced as an inlay part in the intermediate base, or fixed on the intermediate base as a component.

12. The ring according to claim 1, wherein at least the first holding element is formed as an injection moulded part and is fixed on an inside of the side wall, or is moulded integrally on the inside of the side wall.

13. The ring according to claim 1, wherein a third holding element is provided, and the first and third-holding elements are arranged with the same distance to a central longitudinal axis on an inside of one side wall, and fourth holding element is provided, the second and fourth holding elements arranged at the same distance to a second central longitudinal axis on an inside of the opposite side wall, wherein a distance of the second and fourth holding elements compared to a distance first and third holding elements is shortened in terms of the width, and respective engagement elements of the intermediate base are provided opposite the respective holding elements in an alignment of the intermediate base in a usage position.

14. The ring according to claim 1, wherein the side walls are connected to an intermediate web for forming a foldable corner region, and a folding edge is provided embossed, between the side walls and the intermediate web.

15. A transportation container having a transportation palette, having a container upper part and having a collapsible ring according to claim 1, which can be placed on the palette base for connection of the container upper part to the transportation palette.

16. A collapsible ring made of several side walls for a transportation container, which can be positioned to stand on a palette base of a transportation palette and surrounds an interior delimited by the side walls, and at least one intermediate base that can be arranged in the ring in a usage position and having at least one releasable connection formed between the side wall and the intermediate base, said connection being formed by at least one holding element, wherein the adjacent and/or opposite side walls are held by the releasable connection at a distance from the intermediate base, and the intermediate base is positioned by the releasable connection simultaneously in the usage position in relation to the adjacent side wall, wherein at least a first holding element and a second holding element are provided on an inside of one of the side walls, the first holding element and the second holding element being located at respective distances to the a central longitudinal axis, wherein the first distance differs from the second distance in terms of the width of the holding element, and the holding elements are arranged point-symmetrically or in a mirror image to a central line in parallel between the opposite side walls on the inside of the opposite side wall, and the engagement elements of the intermediate base are arranged opposite the holding elements in the usage position.

17. A collapsible ring made of several side walls for a transportation container, which can be positioned to stand on a palette base of a transportation palette and surrounds an interior delimited by the side walls, and at least one intermediate base that can be arranged in the ring in a usage position and having at least one releasable connection formed between the side wall and the intermediate base, said connection being formed by at least one holding element, wherein the adjacent and/or opposite side walls are held by the releasable connection at a distance from the intermediate base, and the intermediate base is positioned by the releasable connection simultaneously in the usage position in relation to the adjacent side wall, wherein the intermediate base and at least two opposite front faces have depressions, which correspond at least to double the width of the holding elements when seen in the vertical direction and, in terms of depth, to a protrusion of the holding elements into the container interior.

18. The ring according to claim 17, wherein at least two holding elements are respectively provided on two opposite insides of the side walls.

19. The ring according to claim 17, wherein engagement elements are positioned in the depressions provided on the front sides of the intermediate base and extend inside an envelope formed by the front sides of the intermediate base.

* * * * *